US010224633B2

(12) United States Patent
Mikami

(10) Patent No.: US 10,224,633 B2
(45) Date of Patent: Mar. 5, 2019

(54) DEFORMED FOLDED DIPOLE ANTENNA

(71) Applicant: DENSO CORPORATION, Kariya, Aichi-pref. (JP)

(72) Inventor: Seishin Mikami, Kariya (JP)

(73) Assignee: DENSO CORPORATION, Kariya, Aichi-pref. (JP)

( * ) Notice: Subject to any disclaimer, the term of this patent is extended or adjusted under 35 U.S.C. 154(b) by 280 days.

(21) Appl. No.: 15/027,052

(22) PCT Filed: Sep. 24, 2014

(86) PCT No.: PCT/JP2014/004876
§ 371 (c)(1),
(2) Date: Apr. 4, 2016

(87) PCT Pub. No.: WO2015/052883
PCT Pub. Date: Apr. 16, 2015

(65) Prior Publication Data

US 2016/0240926 A1 Aug. 18, 2016

(30) Foreign Application Priority Data

Oct. 7, 2013 (JP) ..... 2013-210333

(51) Int. Cl.
*H01Q 9/26* (2006.01)
*H01Q 1/24* (2006.01)

(52) U.S. Cl.
CPC ..... *H01Q 9/26* (2013.01); *H01Q 1/24* (2013.01); *H01Q 1/243* (2013.01)

(58) Field of Classification Search
CPC ..... H01Q 9/26; H01Q 1/24; H01Q 1/243
USPC ..... 343/803, 702
See application file for complete search history.

(56) References Cited

U.S. PATENT DOCUMENTS

2008/0204329 A1* 8/2008 Taki ..... H01Q 1/2225 343/700 MS
2011/0080331 A1* 4/2011 Kato ..... H01Q 1/2216 343/803
2011/0122038 A1* 5/2011 Koide ..... H01Q 9/0407 343/803

FOREIGN PATENT DOCUMENTS

JP 2005260567 A 9/2005
JP 2008112441 A 5/2008
JP 2011130411 A 6/2011

* cited by examiner

*Primary Examiner* — Hai Tran
(74) *Attorney, Agent, or Firm* — Harness, Dickey & Pierce, P.L.C.

(57) ABSTRACT

A deformed folded dipole antenna includes: a feed-side parallel part; a non-feed side parallel part arranged to be parallel to the feed-side parallel part; and a pair of short circuit portions respectively connecting to both ends of the feed-side parallel part and both ends of the non-feed side parallel part. The non-feed side parallel part includes: a pair of opposite sides that are arranged to be opposite from each other; and a connecting side that connects one ends of the pair of opposite sides together. The feed-side parallel part includes a first L-shaped portion and a second L-shaped portion. At least one of the feed-side parallel part and the non-feed side parallel part has one portion arranged with an inward protruding part, which protrudes inwardly.

19 Claims, 10 Drawing Sheets

DEFORMED FOLDED DIPOLE ANTENNA

CROSS REFERENCE TO RELATED APPLICATIONS

This application is a U.S. National Phase Application under 35 U.S.C. 371 of International Application No. PCT/JP2014/004876 filed on Sep. 24, 2014 and published in Japanese as WO 2015/052883 A1 on Apr. 16, 2015. This application is based on and claims the benefit of priority from Japanese Patent Application No. 2013-210333 filed on Oct. 7, 2013. The entire disclosures of all of the above applications are incorporated herein by reference.

TECHNICAL FIELD

The present disclosure relates to a deformed folded dipole antenna in which two parallel parts connected together via a short circuit portion are disposed opposite each other.

BACKGROUND ART

Patent Literature 1 discloses a deformed folded dipole antenna. The deformed folded dipole antenna includes a pair of two parallel parts disposed parallel to each other, and short circuit portions having a smaller length than the parallel parts and each connecting the ends of the two parallel parts together. One of the two parallel parts includes a feed point, while the other parallel part does not include a feed point.

The parallel part that does not include a feed point (hereinafter, non-feed side parallel part) has a shape in which three sides are connected at right angles. Specifically, the non-feed side parallel part includes a pair of opposite sides disposed opposite each other, and a connecting side that connects the pair of opposite sides together at one end thereof.

On the other hand, the parallel part that includes a feed point (hereinafter, feed-side parallel part) has a shape that includes a pair of L-shaped portions. Specifically, the feed-side parallel part includes an L-shaped portion that faces part of one opposite side and part of the connecting side of the non-feed side parallel part, and an L-shaped portion that faces part of the other opposite side and part of the connecting side of the non-feed side parallel part. In other words, the feed-side parallel part includes two L-shaped portions.

Patent Literature 1 also discloses a method of adjusting impedance of the deformed folded dipole antenna. Patent Literature 1 discloses a method of adjusting impedance, wherein W1 to W4 are defined as follows and W1 to W4 are adjusted to have specific relationships with each other.

W1 to W4 are defined as follows. W1 is a width of parts of the two L-shaped portions that face the opposite sides. W2 is a width of parts of the two L-shaped portions that face the connecting side. W3 is a width of the opposite sides of the non-feed side parallel part. W4 is a width of the connecting side of the non-feed side parallel part.

Patent Literature 1 also discloses that, by adjusting the widths W1 to W4 such that W2>W1, W3, and W4, for example, an increase in the size of the antenna can be reduced. Nevertheless, a further reduction in size of deformed folded dipole antennas is desired in cases where the antenna is mounted on a portable device or the like.

PRIOR ART LITERATURES

Patent Literature

Patent Literature 1: JP-2011-130411 A

SUMMARY OF INVENTION

The present disclosure was made in view of such circumstances and its object is to provide an even smaller deformed folded dipole antenna.

According to an aspect of the present disclosure, a deformed folded dipole antenna includes a feed-side parallel part that has a feed point; a non-feed side parallel part that has no feed point and is arranged to be parallel to the feed-side parallel part; and a pair of short circuit portions that have a length smaller than a length of the feed-side parallel part and a length of the non-feed side parallel part, and respectively connect to both ends of the feed-side parallel part and both ends of the non-feed side parallel part. The non-feed side parallel part includes: a pair of opposite sides that are arranged to be opposite from each other, and a connecting side that connects one end of one of the pair of opposite sides and one end of another one of the pair of opposite sides together. The feed-side parallel part includes: a first L-shaped portion that has a first side and a second side, which are respectively opposed to one portion of one of the pair of opposite sides of the non-feed side parallel part and one portion of the connecting side of the non-feed side parallel part; and a second L-shaped portion that has a first side and a second side, which are respectively opposed to one portion of another one of the pair of opposite sides of the non-feed side parallel part and one portion of the connecting side of the non-feed side parallel part. In addition, at least one of the feed-side parallel part and the non-feed side parallel part has one portion arranged with at least one inward protruding part, which protrudes inwardly into an area surrounded by the feed-side parallel part or the non-feed side parallel part.

Since the deformed folded dipole antenna includes the inward protruding part that protrudes inwardly in part of at least one of the feed-side parallel part and the non-feed side parallel part, the wire length is longer than a deformed folded dipole antenna without an inward protruding part. Since the inward protruding part protrudes inwardly into the area surrounded by the feed-side parallel part or the non-feed side parallel part, the antenna is not increased in size even though the antenna includes the inward protruding part. Therefore, the antenna can be reduced in size with the same wire length, as compared to an antenna without an inward protruding part.

BRIEF DESCRIPTION OF DRAWINGS

The above and other objects, features and advantages of the present disclosure will become more apparent from the following detailed description made with reference to the accompanying drawings. In the drawings.

EMBODIMENTS FOR CARRYING OUT INVENTION

Embodiment 1

Hereinafter, embodiments of the present disclosure will be described with reference to the drawings. A deformed folded dipole antenna (hereinafter, simply "antenna") of Embodiment 1 has a configuration shown in FIG. 1 and FIG. 2. The antenna of Embodiment 1 is configured to extend over both sides of a planar board (not shown). The board is a commonly known board and made of a dielectric material such as glass epoxy.

[Configuration of the Solder Side]

Figure 1:
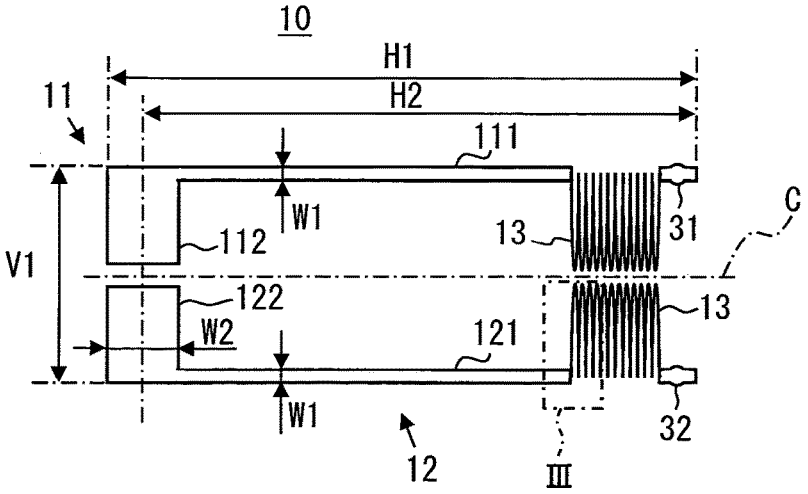
FIG. 1 is a diagram showing a configuration of a solder side of a deformed folded dipole antenna of Embodiment 1.

On the solder side of the board shown in FIG. 1, a feed-side parallel part 10 of the antenna is formed by a conductor foil pattern. The feed-side parallel part 10 includes two L-shaped portions, i.e., a first L-shaped portion 11 and a second L-shaped portion 12, symmetrical about a plane at the center in a width direction of the antenna (hereinafter, widthwise center plane) C.

The first L-shaped portion 11 includes a long side 111 and a short side 112, which correspond to a first side and a second side, respectively. The long side 111 is parallel to the widthwise center plane C. The short side 112 is shorter than the long side 111 and connected to one end of the long side 111, and protrudes perpendicularly from the long side 111 toward the widthwise center plane C.

The second L-shaped portion 12 has a similar configuration as that of the first L-shaped portion 11, and includes a long side 121 and a short side 122, which correspond to a first side and a second side, respectively. The long side 121 has the same length and width as those of the long side 111 of the first L-shaped portion 11, and is positioned opposite the long side 111 of the first L-shaped portion 11 over the widthwise center plane C. The short side 122 is shorter than the long side 121 and connected to one end of the long side 121, at the same end as that of the first L-shaped portion 11 where the short side 112 is connected to the long side 111. The short side 122 protrudes perpendicularly from the long side 121 toward the widthwise center plane C. The short side 122 has the same width and length as those of the short side 112 of the first L-shaped portion 11.

Thus, the first L-shaped portion 11 and second L-shaped portion 12 are identical in shape and disposed such that their short sides 112 and 122 face each other. The ends of the short sides 112 and 122 are feed points. The widthwise center plane C mentioned above is a plane that is perpendicular to the solder side of the board and parallel to the long side 111 of the first L-shaped portion 11 and to the long side 121 of the second L-shaped portion 12. The widthwise center plane C extends along a width direction of the feed-side parallel part 10 and a non-feed side parallel part 20 (i.e., direction vertical to the paper plane of FIG. 1 and FIG. 2).

A short circuit portion 31 that extends vertically through the board is formed near the end of the long side 111 opposite from the end where the short side 112 is connected. A short circuit portion 32 that extends vertically through the board is also formed near the end of the other long side 121 opposite from the end where the short side 122 is connected. These two short circuit portions 31 and 32 are each formed at positions distanced the same from the ends of the long sides 111 and 121 opposite from the ends where the short sides 112 and 122 are connected.

The first L-shaped portion 11 and second L-shaped portion 12 are partly formed with a plurality of inward protruding parts 13. The inward protruding parts 13 protrude inwardly from linear portions of the long sides 111 and 121 of the first L-shaped portion 11 and second L-shaped portion 12 into the area surrounded by the first L-shaped portion 11 and second L-shaped portion 12 on the solder side.

The inward protruding parts 13 in this embodiment each have a semi elliptical shape. Therefore, the width of each inward protruding part 13 at the distal end is smaller than that of the proximal end, i.e., the length between two end points, and decreases continuously toward the tip.

The number of inward protruding parts 13 formed to each of the long side 111 of the first L-shaped portion 11 and the long side 121 of the second L-shaped portion 12 is twelve. The twelve inward protruding parts 13 are disposed continuously from near the short circuit portion 31 of the long side 111 of the first L-shaped portion 11 toward the short side 112. Similarly, the twelve inward protruding parts are disposed continuously from near the short circuit portion 32 of the long side 121 of the second L-shaped portion 12 toward the short side 122.

Figure 3:
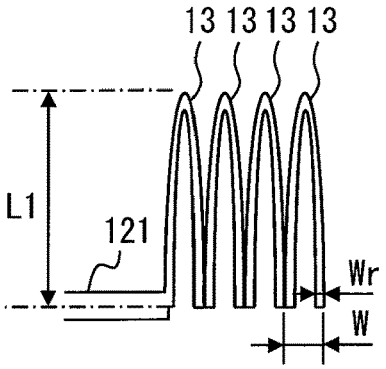
FIG. 3 is an enlarged view of area III indicated with a one dot chain line in FIG. 1.

Here, "continuously" means that one inward protruding part 13 shares an end with another inward protruding part 13 adjacent to that inward protruding part 13, as shown in FIG. 3. In this embodiment, both ends of the inward protruding parts 13 are located on a widthwise centerline of the long side 121. Each inward protruding part 13 is formed by the wire being folded at one end and protruded inwardly from a linear portion of the long side 121, bent back at the distal end, and connected again at the other end to the linear portion of the long side 121. As shown in FIG. 3, the width of the proximal part, height, and wire width of the inward protruding part 13 will be referred to as W, L1, and Wr, respectively. These will be used later in the comparison of wire lengths.

The feed-side parallel part 10 having such a configuration has a length H1 along a longitudinal direction, which is the length of the long sides 111 and 121, and a length V1 in a widthwise direction, as shown in FIG. 1. The width of the long sides 111 and 121 is W1, and the width of the short sides 112 and 122 is W2. The length from the ends with the short circuit portions 31 and 32 of the long sides 111 and 121 to a widthwise centerline of the short sides 112 and 122 will be referred to as H2.

[Configuration of the Component Side]

Figure 2:
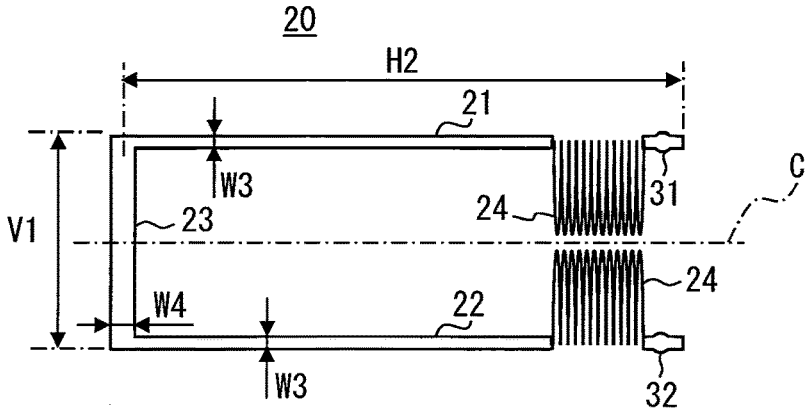
FIG. 2 is a diagram showing a configuration of a component side of the deformed folded dipole antenna of Embodiment 1.

On the component side of the board shown in FIG. 2, a non-feed side parallel part 20 of the antenna is formed by a conductor foil pattern. The non-feed side parallel part 20 includes a pair of opposite sides 21 and 22 disposed opposite each other, and a connecting side 23 that connects the pair of opposite sides 21 and 22 together at one end thereof.

The opposite sides 21 and 22 are parallel to each other and identical in length and width. One end of the short circuit portion 31 mentioned above is located near the end of the opposite side 21 opposite from the end where the connecting side 23 is connected. One end of the other short circuit portion 32 is located near the end of the opposite side 22 opposite from the end where the connecting side 23 is connected.

The opposite side 21 has a length of H2 that is mentioned above, from the end with the short circuit portion 31 to a widthwise center of the connecting side 23, and is opposite the long side 111 of the first L-shaped portion 11 of the feed-side parallel part 10 via the board.

The other opposite side 22, too, has a length of H2 from the end with the short circuit portion 32 to the widthwise center of the connecting side 23. This opposite side 22 is opposite the long side 121 of the second L-shaped portion 12 of the feed-side parallel part 10 via the board. The width of these opposite sides 21 and 22 will be referred to as W3.

The connecting side 23 is perpendicular to the two opposite sides 21 and 22, and has a length V1 in a longitudinal direction and a width W4. This connecting side 23 is opposite the short side 112 of the first L-shaped portion 11 and the short side 122 of the second L-shaped portion 12 of the feed-side parallel part 10 via the board.

The opposite sides 21 and 22 are formed with inward protruding parts 24 that protrude inwardly into an area surrounded by the opposite sides 21 and 22 and the connecting side 23. In this embodiment, the inward protruding parts 24 have the same shape as the inward protruding parts 13 formed to the feed-side parallel part 10, i.e., the inward protruding parts 24 each have a semi elliptical shape, too. The inward protruding parts 24 are also identical to the inward protruding parts 13 in size. Twenty-four inward protruding parts 24 are formed in this embodiment similarly to the inward protruding parts 13, each of the inward protruding parts 24 being formed at a position opposite the corresponding one of the inward protruding parts 13.

[Impedance Adjustment]

Impedance adjustment of the antenna in this embodiment is carried out according to the method disclosed in Patent Literature 1 or other known methods. Specifically, impedance is adjusted by one of the following methods (1) to (5):

(1) W1 to W4 are adjusted so that W2>W1, W3, and W4.

(2) W1 to W4 are adjusted so that W3>W1, W2, W4.

(3) The ratio W2/W4 is adjusted while W3 and W1 are fixed.

(4) W1 to W4 are adjusted so that W1>W2, W3, and W4.

(5) W1 to W4 are adjusted so that W4>W1, W2, W3.

Effects of Embodiment 1

According to Embodiment 1 described above, the feed-side parallel part 10 includes inward protruding parts 13 protruding from the long sides 111 and 121 of the feed-side parallel part 10. The non-feed side parallel part 20 also includes inward protruding parts 24 protruding from the opposite sides 21 and 22 of the non-feed side parallel part 20. Therefore, the antenna of Embodiment 1 has a longer wire length than antennas without these inward protruding parts 13 and 24.

Since the inward protruding parts 13 and 24 protrude inwardly into the area surrounded by the feed-side parallel part 10 or the non-feed side parallel part 20, the antenna is not increased in size even though the antenna includes the inward protruding parts 13 and 24. Therefore, the antenna can be reduced in size with the same wire length, as compared to antennas without the inward protruding parts 13 and 24.

Since the inward protruding parts 13 and 24 have semi elliptical shapes, the inward protruding parts 13 and 24 can be formed continuously. The antenna can be made particularly small because a large number of inward protruding parts 13 and 24 can be formed in a small area.

Embodiment 2

Next, Embodiment 2 will be described. In the following description of Embodiment 2, elements having the same reference numerals that have been used before are the same elements as those with the same reference numerals in the previous embodiment, unless otherwise specified. In cases where only part of a configuration is described, the previously described embodiment can be applied to other features of the configuration.

Figure 4:
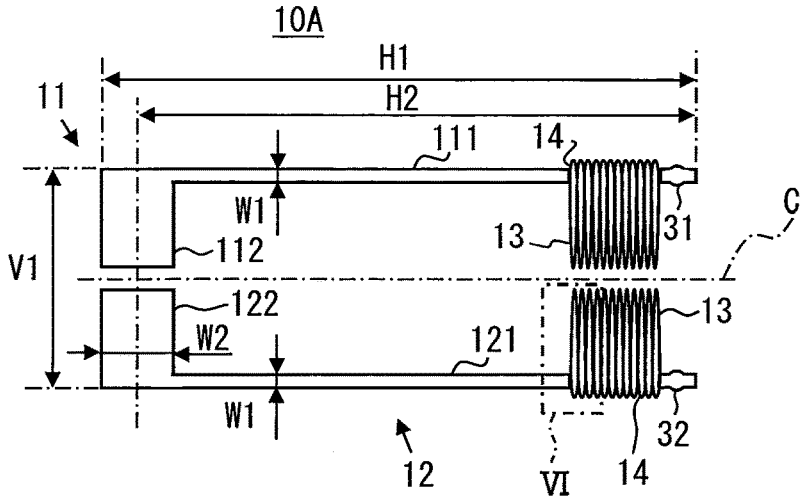
FIG. 4 is a diagram showing a configuration of a solder side of a deformed folded dipole antenna of Embodiment 2.
Figure 5:
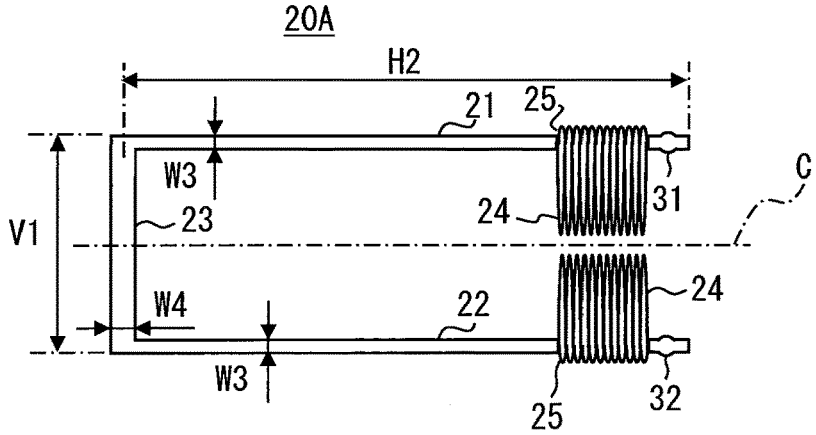
FIG. 5 is a diagram showing a configuration of a component side of the deformed folded dipole antenna of Embodiment 2.

A feed-side parallel part 10A of the antenna in Embodiment 2 further includes end connectors 14 that connect ends of each inward protruding part 13, as shown in FIG. 4. A non-feed side parallel part 20A further includes end connectors 25 that connect ends of each inward protruding part 24, as shown in FIG. 5. The feed-side parallel part 10A and non-feed side parallel part 20A of Embodiment 2 are different from the feed-side parallel part 10 and non-feed side parallel part 20 of Embodiment 1 only in these respects.

Figure 6:
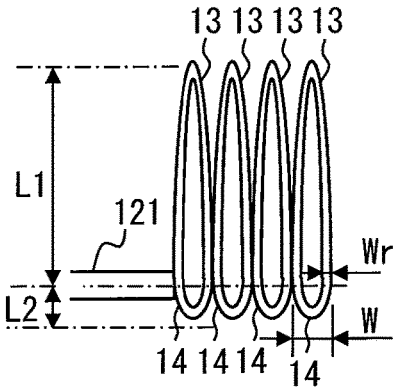
FIG. 6 is an enlarged view of area IV indicated with a one dot chain line in FIG. 4.

As shown in FIG. 6, which is an enlarged view of area VI indicated with a one dot chain line in FIG. 4, the end connector 14 connects one end and the other end of each semi elliptical inward protruding part 13. The end connector 14 of Embodiment 2 has a semi elliptical shape and, unlike the inward protruding parts 13, the end connector 14 protrudes outward. The end connector 14 has a height L2, as shown in FIG. 6. The end connector 25 of the non-feed side parallel part 20A includes also has the same configuration as this end connector 14.

The antenna may have a configuration with the end connectors 14 and 25 such as this Embodiment 2. The effects achieved by providing the end connectors 14 and 25 will be explained in the description of Embodiment 3. In Embodiment 2, too, impedance is adjusted by the methods described in Embodiment 1.

Embodiment 3

Figure 7:
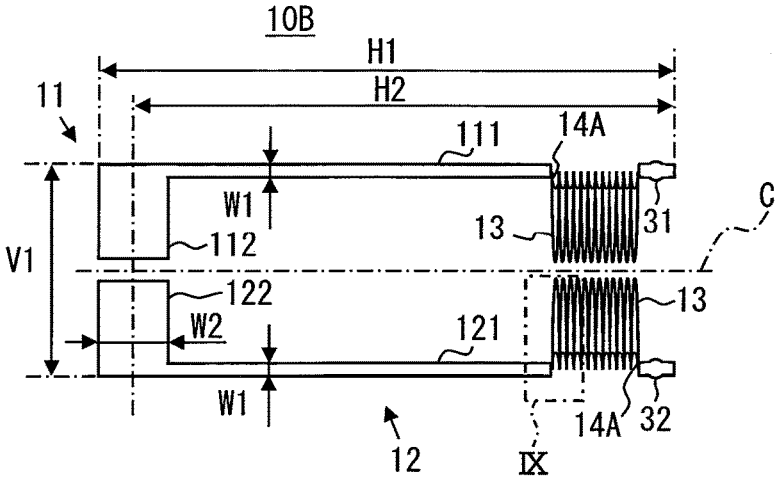
FIG. 7 is a diagram showing a configuration of a solder side of a deformed folded dipole antenna of Embodiment 3.
Figure 8:
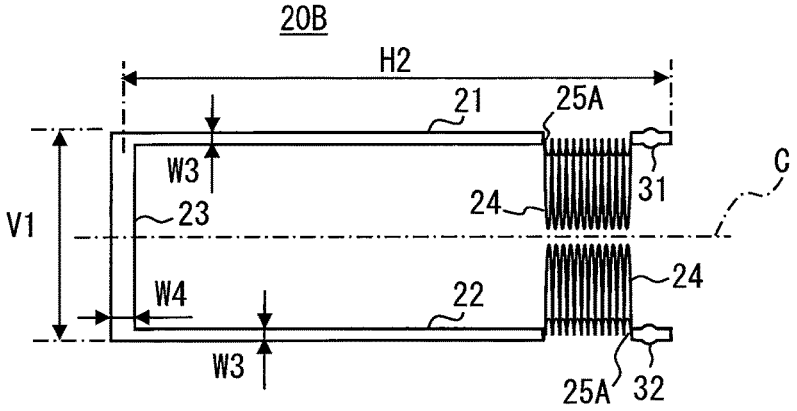
FIG. 8 is a diagram showing a configuration of a component side of the deformed folded dipole antenna of Embodiment 3.

A feed-side parallel part 10B of the antenna in Embodiment 3 further includes end connectors 14A that connect ends of each inward protruding part 13, as shown in FIG. 7. A non-feed side parallel part 20B further includes end connectors 25A that connect ends of each inward protruding part 24, as shown in FIG. 8. The feed-side parallel part 10B and non-feed side parallel part 20B of Embodiment 3 are different from the feed-side parallel part 10 and non-feed side parallel part 20 of Embodiment 1 only in these respects.

Figure 9:
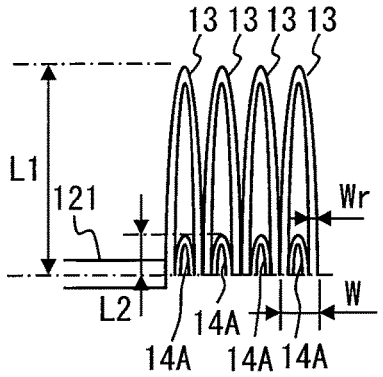
FIG. 9 is an enlarged view of area IX indicated with a one dot chain line in FIG. 7.

As shown in FIG. 9, which is an enlarged view of area IX indicated with a one dot chain line in FIG. 7, the end connector 14A also connects one end and the other end of each inward protruding part 13, and has a semi elliptical shape. Unlike Embodiment 2, this end connector 14A protrudes inward, similarly to the inward protruding parts 13. Although the end connector 14A protrudes in a different direction from that of Embodiment 2, the end connector 14A has a height L2, as shown in FIG. 9, similarly to the end connector 14 of Embodiment 2. The end connector 25A of the non-feed side parallel part 20B includes also has the same configuration as this end connector 14A. In Embodiment 3, too, impedance is adjusted by the methods described in Embodiment 1.

Effects of Embodiments 2 and 3

The effects of providing the end connectors 14, 14A, 25, and 25A as in Embodiments 2 and 3 will now be described.

Figure 10:
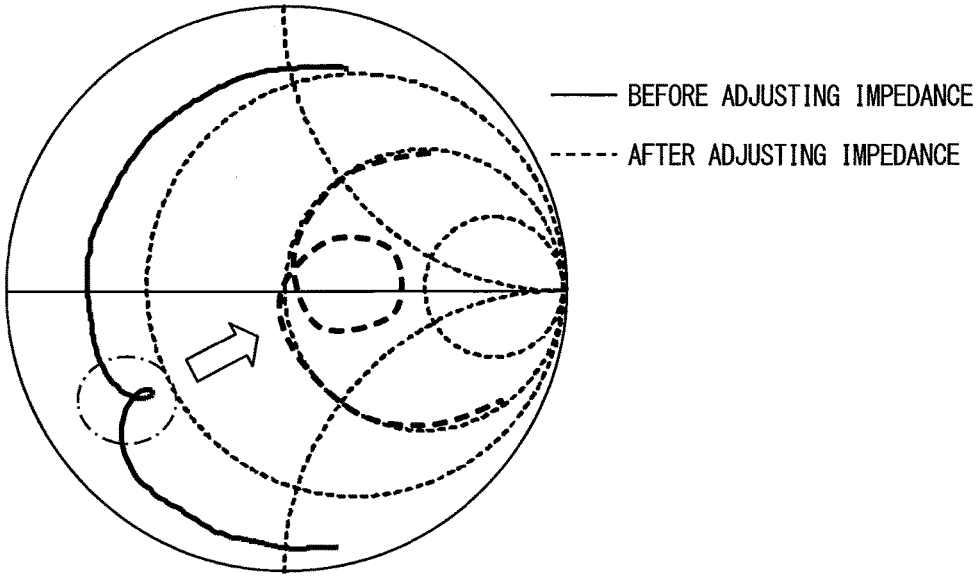
FIG. 10 is a smith chart showing impedance characteristics of the antenna of Embodiment 1.

FIG. 10 is a diagram showing a smith chart, which is obtained by calculating impedance of the antenna of Embodiment 1 through simulation. In FIG. 10, the solid line indicates impedance before adjustment, while the broken line indicates impedance after adjustment. Calculation for the chart of FIG. 10 is made with the parameters being as follows: H1=45.575 mm, V1=12.4 mm, W1=0.4 mm, W2=4.8 mm, W3=0.4 mm, W4=1.2 mm, L1=6 mm, W=0.6 mm, Wr=0.2 mm, and with the number of continuous inward protruding parts 13 being twelve. The broken line indicates estimated values.

Figure 11:
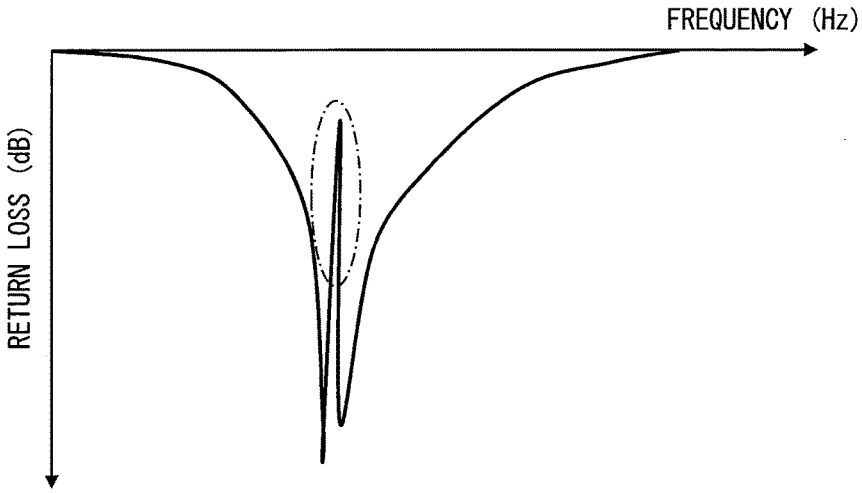
FIG. 11 is a diagram showing a magnitude of return loss relative to frequency of the antenna of Embodiment 1.

In a portion of the solid line that is encircled by a one dot chain line, there is a small resonance point. Therefore, it is assumed that a small resonance point remains as indicated with the broken line even after the adjustment of impedance. In the case with the impedance characteristics shown by the broken lines in FIG. 10, it is assumed that return loss variation occurs as indicated with the one dot chain line in FIG. 11. Once return loss variation occurs, it may cause problems in use.

Figure 12:
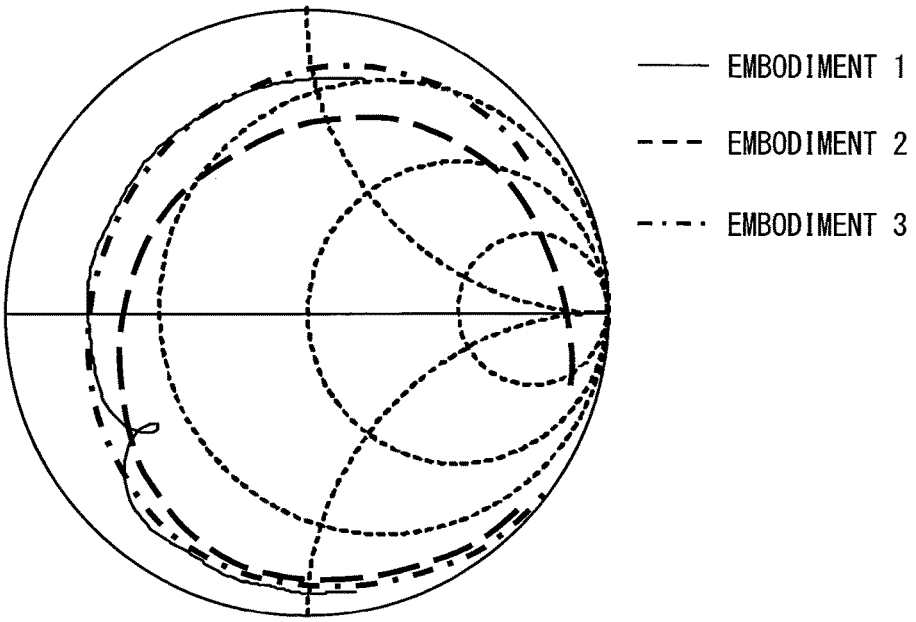
FIG. 12 is a smith chart showing impedance characteristics of the antennas of Embodiments 1, 2, and 3 in comparison with each other.

In contrast, with the end connectors 14, 25, 14A, and 25A, the small resonant point is eliminated, as shown in FIG. 12. Specifically, in FIG. 12, the solid line indicates the impedance characteristics of the antenna of Embodiment 1, as with the solid line of FIG. 10. The broken line indicates the impedance characteristics of the antenna of Embodiment 2, i.e., with the outwardly protruding end connectors 14 and 25. The one dot chain line indicates the impedance characteristics of the antenna of Embodiment 3, i.e., with the inwardly protruding end connectors 14A and 25A. It can be seen from FIG. 12 that, in Embodiment 2 and Embodiment 3, there are no small resonance points.

Accordingly, with the end connectors 14, 25, 14A, and 25A as in Embodiments 2 and 3, return loss variation is eliminated, in addition to the effects achieved with the antenna of Embodiment 1.

The resonance frequency under the conditions indicated in the description of FIG. 10 is 787 MHz with Embodiment 1 having only the inward protruding parts 13, while the resonance frequency is 821 MHz with Embodiment 2 having the outwardly protruding end connectors 25, and 858 MHz with Embodiment 3 having the inwardly protruding end connectors 25A. In contrast, when there are provided no inward protruding part 13, the resonance frequency is 1333 MHz.

Therefore, the antenna of Embodiment 1 has a frequency ratio of 0.59, relative to the resonance frequency when there are no inward protruding parts 13, while the antenna of Embodiment 2 has a frequency ratio of 0.62, and the antenna of Embodiment 3 has a frequency ratio of 0.64. It can be understood from these, too, that the antenna can be made smaller by providing the inward protruding parts 13, irrespective of the presence of the end connectors 25 and 25A.

Embodiment 4

Figure 13:
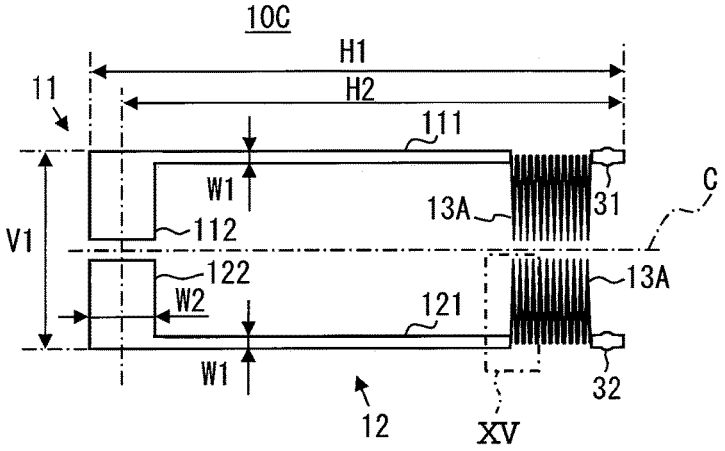
FIG. 13 is a diagram showing a configuration of a solder side of a deformed folded dipole antenna of Embodiment 4.
Figure 14:
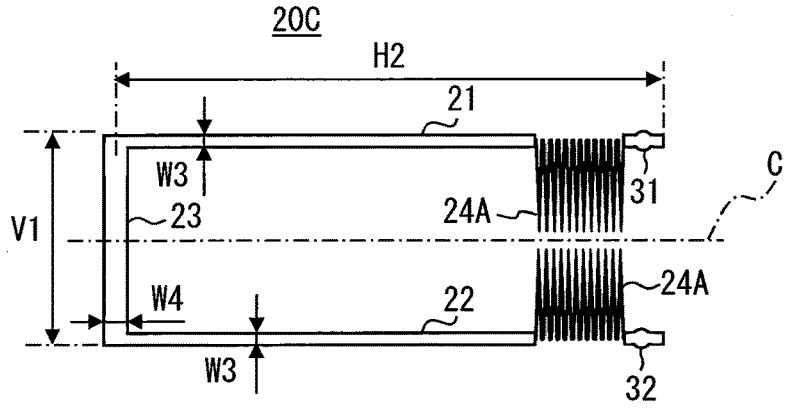
FIG. 14 is a diagram showing a configuration of a component side of the deformed folded dipole antenna of Embodiment 4.

A feed-side parallel part 10C of the antenna in Embodiment 4 is formed with inward protruding parts 13A in the long sides 111 and 121, as shown in FIG. 13. As shown in FIG. 14, inward protruding parts 24A are also formed to a non-feed side parallel part 20C.

Figure 15:
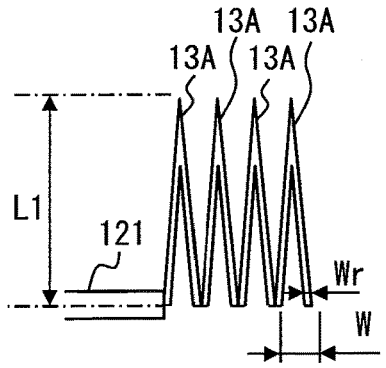
FIG. 15 is an enlarged view of area XV indicated with a one dot chain line in FIG. 13.

As shown in FIG. 15, which is an enlarged view of area XV indicated with a one dot chain line in FIG. 13, the inward protruding parts 13A each have an isosceles triangle shape. The inward protruding parts 24A of the non-feed side parallel part 20C also each have the same shape as that of the inward protruding parts 13A shown in FIG. 15.

Embodiment 4 is different from the previously described embodiments only in the shape of these inward protruding parts 13A and 24A. The number, position, and size of the inward protruding parts 13A and 24A are the same as those of the inward protruding parts 13 of the previously described embodiments. The wire width Wr is also the same as that of the inward protruding parts 13 of the previously described embodiments.

With the inward protruding parts 13A and 24A in the shape of an isosceles triangle, too, since the inward protruding parts 13A and 24A are pointed at the tips, the width at the distal end is smaller than the width W of the proximal end, and the width decreases continuously toward the tip. Therefore, as shown in FIG. 15, the inward protruding parts 13A and 24A can be in the shape of an isosceles triangle and can still be formed continuously.

The antenna can be made particularly small because a large number of inward protruding parts 13A and 24A can be formed in a small area. In Embodiment 4, too, impedance is adjusted by the methods described in Embodiment 1.

Embodiment 5

Figure 16:
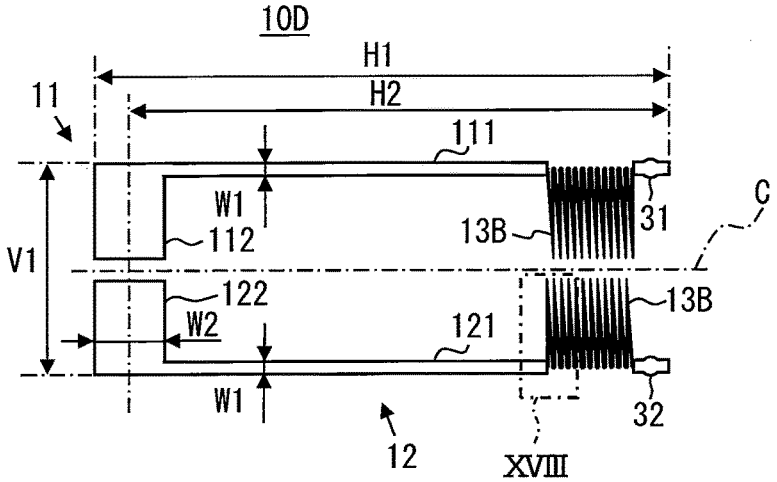
FIG. 16 is a diagram showing a configuration of a solder side of a deformed folded dipole antenna of Embodiment 5.
Figure 17:
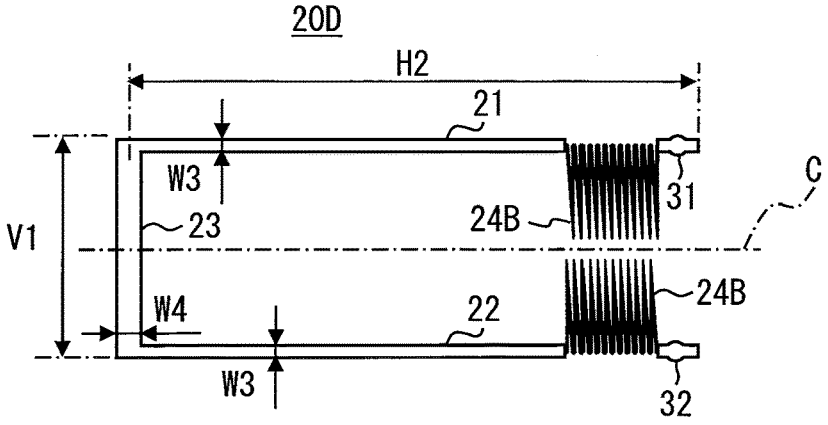
FIG. 17 is a diagram showing a configuration of a component side of the deformed folded dipole antenna of Embodiment 5.

A feed-side parallel part 10D of the antenna in Embodiment 5 is formed with inward protruding parts 13B in the long sides 111 and 121, as shown in FIG. 16. As shown in FIG. 17, inward protruding parts 24B are also formed to a non-feed side parallel part 20D.

Figure 18:
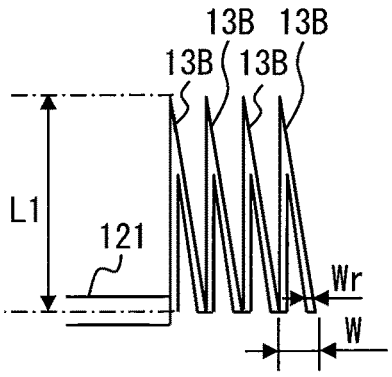
FIG. 18 is an enlarged view of area XVIII indicated with a one dot chain line in FIG. 16.

As shown in FIG. 18, which is an enlarged view of area XVIII indicated with a one dot chain line in FIG. 16, the inward protruding parts 13B each have a right-angled triangle shape. The inward protruding parts 24B of the non-feed side parallel part 20D also each have the same shape as that of the inward protruding parts 13B shown in FIG. 18.

Embodiment 5 is different from the previously described embodiments only in the shape of these inward protruding parts 13B and 24B. The number, position, and size of the inward protruding parts 13B and 24B are the same as those of the previously described embodiments.

With the inward protruding parts 13B and 24B in the shape of a right-angled triangle, too, since the inward protruding parts 13B and 24B are pointed at the tips, the width at the distal end is smaller than the width W of the proximal end, and the width decreases continuously toward the tip. Therefore, as shown in FIG. 18, the inward protruding parts 13B and 24B can be in the shape of a right-angled triangle and can still be formed continuously.

The antenna can be made particularly small because a large number of inward protruding parts 13B and 24B can be formed in a small area. In Embodiment 5, too, impedance is adjusted by the methods described in Embodiment 1.

Embodiment 6

Figure 19:
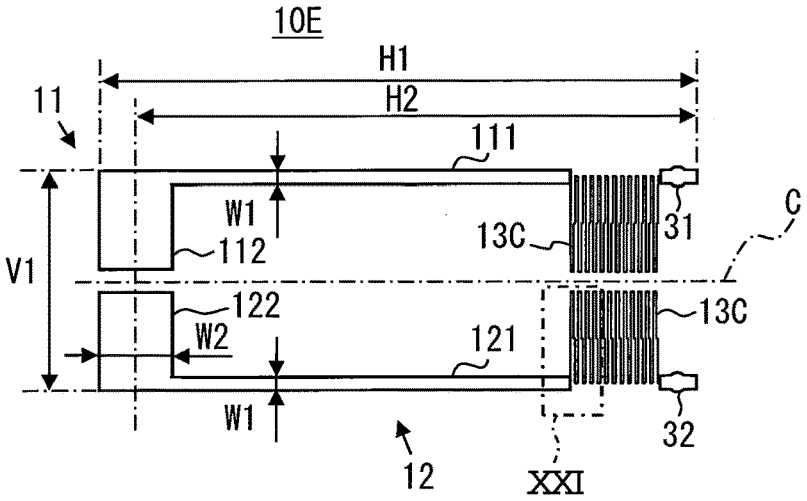
FIG. 19 is a diagram showing a configuration of a solder side of a deformed folded dipole antenna of Embodiment 6.
Figure 20:
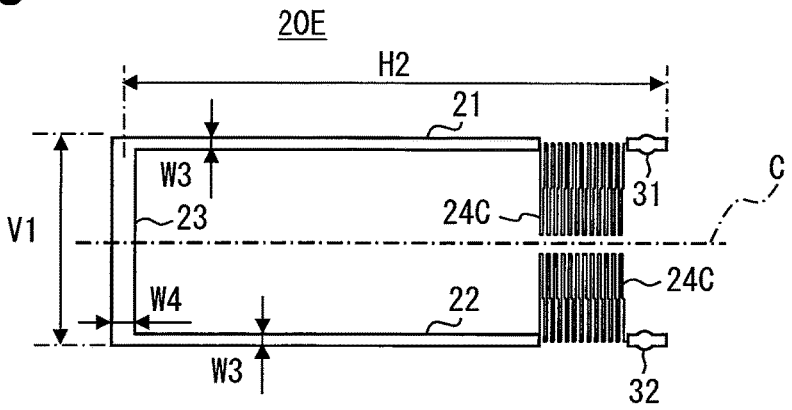
FIG. 20 is a diagram showing a configuration of a component side of the deformed folded dipole antenna of Embodiment 6.

A feed-side parallel part 10E of the antenna in Embodiment 6 is formed with inward protruding parts 13C in the long sides 111 and 121, as shown in FIG. 19. As shown in FIG. 20, inward protruding parts 24C are also formed to a non-feed side parallel part 20E.

Figure 21:
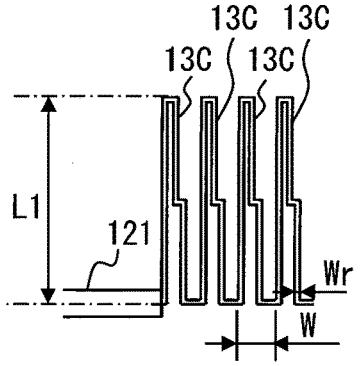
FIG. 21 is an enlarged view of area XXI indicated with a one dot chain line in FIG. 19.

As shown in FIG. 21, which is an enlarged view of area XXI indicated with a one dot chain line in FIG. 19, the inward protruding parts 13C each have a stepped shape. The height L1 and the wire width Wr of the inward protruding part 13C are the same as those of the inward protruding parts 13, 13A, and 13B of the previously described embodiments. The width of each repeated unit of the inward protruding part is the same as the width W of the inward protruding parts 13, 13A, and 13B of the previously described embodiments. The number and position of the inward protruding parts 13C are the same as those of the previously described embodiments. The inward protruding parts 24C of the non-feed side parallel part 20E also have the same shape, size, and arrangement as those of the inward protruding parts 13C.

Figure 22:
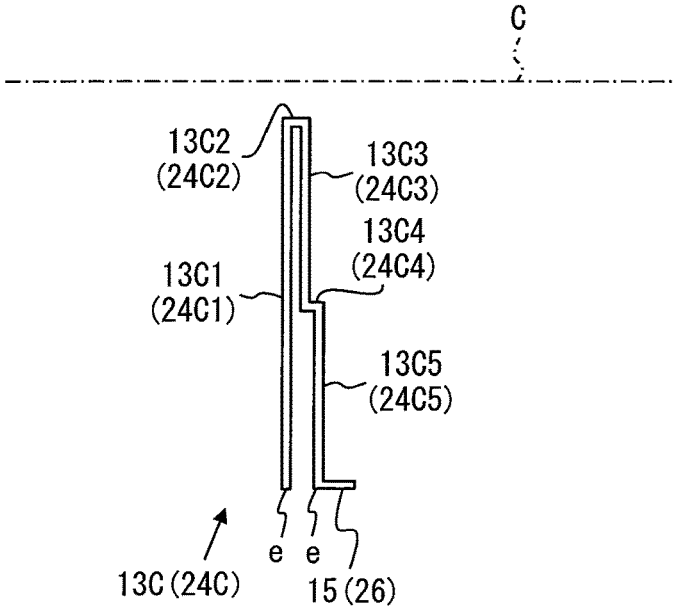
FIG. 22 is a diagram for explaining a configuration of inward protruding parts of Embodiment 6.

Specifically, as shown in FIG. 22, one inward protruding part 13C or 24C includes a first long vertical portion 13C1 or 24C1, a distal end portion 13C2 or 24C2, a first short vertical portion 13C3 or 24C3, a middle portion 13C4 or 24C4, and a second short vertical portion 13C5 or 24C5.

The first long vertical portion 13C1 or 24C1 extends from one end point e of an inward protruding part 13C or 24C toward the antenna widthwise center plane C vertically to the tip of the inward protruding part 13C or 24C.

The distal end portion 13C2 or 24C2 is connected at one end to the distal end of the first long vertical portion 13C1 or 24C1 and parallel to the antenna widthwise center plane C.

The first short vertical portion 13C3 or 24C3 is connected at one end to the distal end portion 13C2 or 24C2 and extends from the distal end portion 13C2 or 24C2 vertically to the antenna widthwise center plane C in a direction away from the antenna widthwise center plane C. The first short vertical portion 13C3 or 24C3 is shorter than the first long vertical portion 13C1 or 24C1.

The middle portion 13C4 or 24C4 is connected at one end to the first short vertical portion 13C3 or 24C3 and extends from the first short vertical portion 13C3 or 24C3 parallel to the antenna widthwise center plane C and oppositely from the first long vertical portion 13C1 or 24C1.

The second short vertical portion 13C5 or 24C5 is vertical to the antenna widthwise center plane C, and connected at one end to the middle portion 13C4 or 24C4. The other end is the end point e of another inward protruding part on the opposite side from the side where the first long vertical portion 13C1 or 24C1 is connected. The second short vertical portion 13C5 or 24C5 is shorter than the first long vertical portion 13C1 or 24C1.

The inward protruding parts 13C or 24C configured as described above are connected to adjacent inward protruding parts 13C or 24C via short connecting wires 15 or 26. The short connecting wires 15 or 26 are formed such that the outer sides are positioned on the widthwise centerline of the long sides 111 and 121 or opposite sides 21 and 22 that are not shown in FIG. 22.

With the inward protruding parts 13C and 24C in a stepped shape, too, since the wire length is longer by the lengths of the inward protruding parts 13C and 24C than when there are no inward protruding parts 13C and 24C, the antenna can be made smaller. In Embodiment 6, too, impedance is adjusted by the methods described in Embodiment 1.

Embodiment 7

Figure 23:
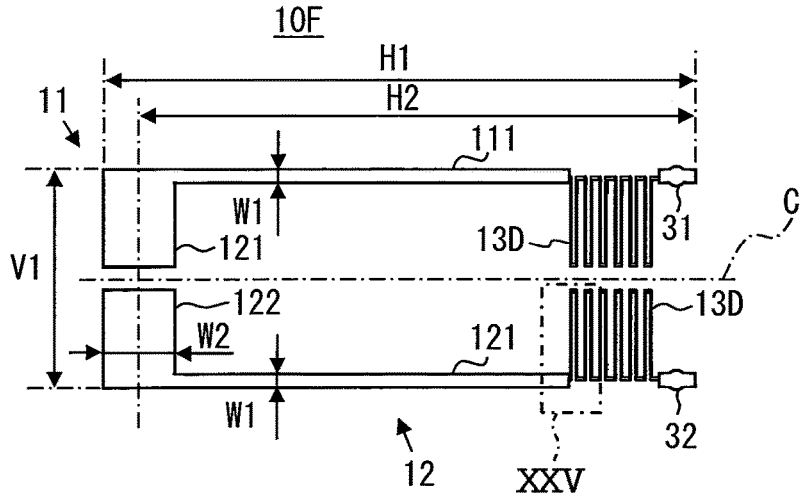
FIG. 23 is a diagram showing a configuration of a solder side of a deformed folded dipole antenna of Embodiment 7.
Figure 24:
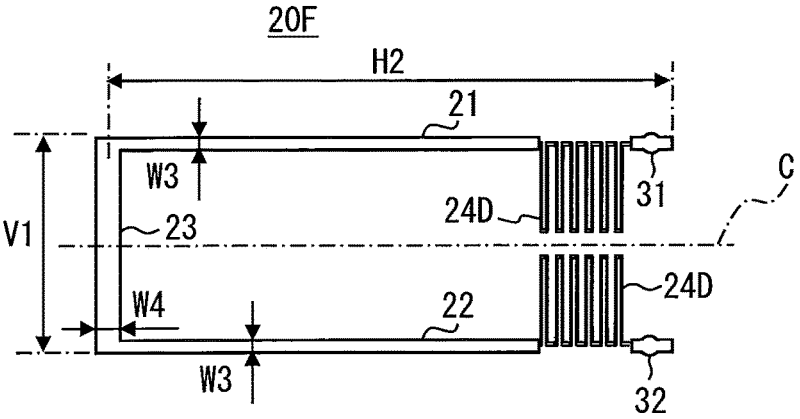
FIG. 24 is a diagram showing a configuration of a component side of the deformed folded dipole antenna of Embodiment 7.

A feed-side parallel part 10F of the antenna in Embodiment 7 is formed with inward protruding parts 13D in the long sides 111 and 121, as shown in FIG. 23. As shown in FIG. 24, inward protruding parts 24D are also formed to a non-feed side parallel part 20F.

Figure 25:
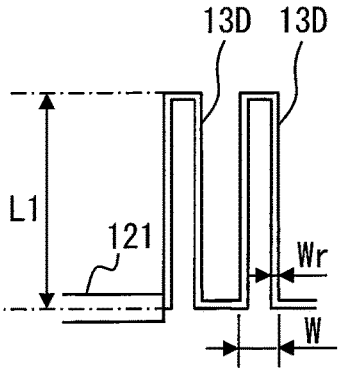
FIG. 25 is an enlarged view of area XXV indicated with a one dot chain line in FIG. 23.

As shown in FIG. 25, which is an enlarged view of area XXV indicated with a one dot chain line in FIG. 23, the inward protruding parts 13D are in a right-angled bent shape with two right-angled bends. The height L1 and the wire width Wr of the inward protruding parts 13D are the same as those of the inward protruding parts 13, 13A, 13B, and 13C of the previously described embodiments. The width of each repeated unit of the inward protruding part is the same as the width W of the inward protruding parts 13, 13A, and 13B of the previously described embodiments. The number and position of the inward protruding parts 13D are the same as those of the previously described embodiments. The inward protruding parts 24D of the non-feed side parallel part 20E also have the same shape, size, and arrangement as those of the inward protruding parts 13D.

Figure 26:
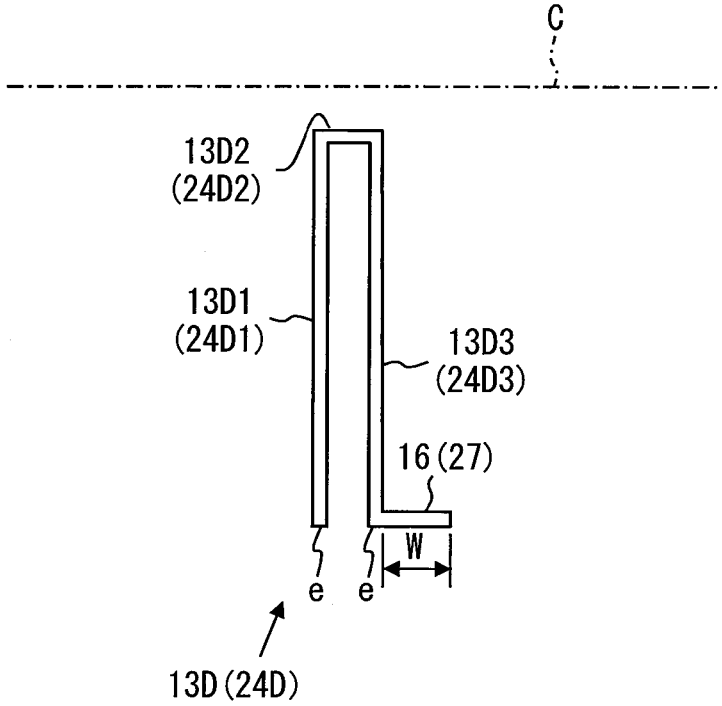
FIG. 26 is a diagram for explaining a configuration of inward protruding parts of Embodiment 7.

Specifically, as shown in FIG. 26, one inward protruding part 13D or 24D includes a first vertical portion 13D1 or 24D1, a distal end portion 13D2 or 24D2, and a second vertical portion 13D3 or 24D3.

The first vertical portion 13D1 or 24D1 extends from one end point e of an inward protruding part 13D or 24D toward the antenna widthwise center plane C vertically to the tip of the inward protruding part 13D or 24D.

The distal end portion 13D2 or 24D2 is connected at one end to the distal end of the first vertical portion 13D1 or 24D1 and parallel to the antenna widthwise center plane C.

The second vertical portion 13D3 or 24D3 is vertical to the antenna widthwise center plane C, and connected at one end to the distal end portion 13D2 or 24D2. The other end is an end point of another inward protruding part 13D or 24D on the opposite side from the first vertical portion 13D1 or 24D1.

The inward protruding parts 13D or 24D configured as described above are connected to adjacent inward protruding parts 13D or 24D via short connecting wires 16 or 27. The short connecting wires 16 or 27 are formed such that the outer sides are positioned on the widthwise centerline of the long sides 111 and 121 or opposite sides 21 and 22 that are not shown in FIG. 26. The length of the short connecting wires 16 and 27 is W, the same as the width of the inward protruding parts 13D and 24D. Therefore, in the case with Embodiment 7, the width of the repeated unit of the inward protruding parts 13D and 24D is 2 W.

With the inward protruding parts 13D and 24D in a right-angled bent shape, too, the antenna can be made smaller, since the wire length is longer by the lengths of the inward protruding parts 13D and 24D than when there are no inward protruding parts 13D and 24D. In Embodiment 7, too, impedance is adjusted by the methods described in Embodiment 1.

[Comparison of Wire Length]

Now, the wire lengths of the inward protruding parts 13, 13A, and 13D as disclosed in Embodiments 1, 4, 7, respectively, i.e., inward protruding parts 13, 13A, and 13D in semi elliptical, isosceles triangular, and right-angled bent shapes, are compared.

The wire length LL (13) of two semi elliptical inward protruding parts 13 (having a width of 2 W) can be expressed by Equation 1 from an elliptic integral.

[Mathematical Formula 1]

$$LL(13) = 2 \times L1 \times E\left(\frac{\pi}{2}, k\right) \quad \text{(Equation 1)}$$

$$E\left(\frac{\pi}{2}, k\right) = \int_0^{\frac{\pi}{2}} \sqrt{1 - k^2 \sin^2\phi}\, d\phi$$

$$k = \sqrt{1 + \left(\frac{W/2}{L1}\right)^2}$$

The wire length LL (13A) of two inward protruding parts 13A in the form of an isosceles triangle (having a width of 2 W) can be expressed by Equation 2.

[Mathematical Formula 2]

$$LL(13A) = 4\sqrt{L1^2 + \left(\frac{W}{2}\right)^2} \quad \text{(Equation 2)}$$

The wire length LL (13D) of one repeated unit of the inward protruding part 13D of a right-angled bent shape with a short connecting wire 16 (having a width of 2 W) can be expressed by Equation 3.

$$LL(13D) = 2(W + L1) \quad \text{(Equation 3)}$$

Where W=0.6 mm and L1=6 mm, the wire lengths LL (13), LL (13A), and LL (13D) are calculated as follows: LL (13)=24.2 mm, LL (13A)=24.0 mm, LL (13D)=13.2 mm.

Wire length ratios of the semi elliptical inward protruding part 13 and the inward protruding part 13A in the shape of an isosceles triangle to the wire length LL of the inward protruding part 13D of a right-angled bent shape, which is the shortest, are both 1.8.

The semi elliptical inward protruding part 13 and the inward protruding part 13A in the shape of an isosceles triangle can be formed continuously as shown in FIG. 3 and FIG. 15. Therefore, the inward protruding parts 13 and 13A can have a larger wire length ratio than the inward protruding parts 13D having a right-angled bent shape.

Other Embodiments

While embodiments of the present disclosure have been described above, the present disclosure is not limited to the embodiments described above. The following embodiments are also included in the technical scope of the present disclosure. Moreover, various other changes can be made without departing from the scope of the subject matter in carrying out the disclosure.

For example, the end connectors 14 and 25 of Embodiment 2 protrude outward, and the end connectors 14A and 25A of Embodiment 3 protrude inward, which means that the end connectors may protrude either inward or outward, and so the end connectors can have a shape that is the middle between the shapes of Embodiments 2 and 3, i.e., the end connectors may be linear.

While the end connectors 14, 14A, 25, and 25A are used for connecting the semi elliptical inward protruding parts 13 only in the embodiments described above, both ends of other inward protruding parts 13A to 13D and 24A to 24D of other shapes may be connected to each other with end connectors 14, 14A, 25, and 25A.

There is no particular limitation on the number and position of the inward protruding parts. For example, the inward protruding parts may be disposed nearer to the short sides 112 and 122 or to the connecting side 23. The inward protruding parts provided to the feed-side parallel part need not necessarily be positioned opposite the inward protruding parts provided to the non-feed side parallel part. The inward protruding parts may be provided to either the feed-side parallel part or the non-feed side parallel part.

While the first L-shaped portion 11 and second L-shaped portion 12 each include a long side 111 or 121 as a first side and a short side 112 or 122 as a second side in the previously described embodiments, the relationship of the lengths of the first side and the second side may be opposite from that of the previously described embodiments. In other words, the second side may be longer than the first side. Alternatively, the first side and the second side may have the same length.

What is claimed is:

1. A deformed folded dipole antenna, comprising:

a feed-side parallel part that has a feed point;

a non-feed side parallel part that has no feed point and is arranged to be parallel to the feed-side parallel part; and a pair of short circuit portions that have a length smaller than a length of the feed-side parallel part and a length of the non-feed side parallel part, and respectively connect to both ends of the feed-side parallel part and both ends of the non-feed side parallel part, wherein:

the non-feed side parallel part includes:

a pair of opposite sides that are arranged to be opposite from each other, and a connecting side that connects one end of one of the pair of opposite sides and one end of another one of the pair of opposite sides together;

the feed-side parallel part includes:

a first L-shaped portion that has a first side and a second side, which are respectively opposed to one portion of one of the pair of opposite sides of the non-feed side parallel part and one portion of the connecting side of the non-feed side parallel part, and a second L-shaped portion that has a first side and a second side, which are respectively opposed to one portion of another one of the pair of opposite sides of the non-feed side parallel part and the one portion of the connecting side of the non-feed side parallel part;

at least one of the feed-side parallel part and the non-feed side parallel part has one portion arranged with at least one inward protruding part, which protrudes inwardly into an area surrounded by the feed-side parallel part or the non-feed side parallel part; and the at least one inward protruding part is arranged between the pair of short circuit portions and at least one of the non-feed side parallel part and the feed-side parallel part.

2. The deformed folded dipole antenna according to claim 1, wherein the at least one inward protruding part has a width at a distal end of the at least one inward protruding part shorter than a width at a proximal end of the at least one inward protruding part.

3. The deformed folded dipole antenna according to claim 2, wherein the width of the at least one inward protruding part gets narrower continuously from the proximal end toward the distal end.

4. The deformed folded dipole antenna according to claim 3, wherein the at least one inward protruding part has a semi-elliptical shape.

5. The deformed folded dipole antenna according to claim 3, wherein the at least one inward protruding part has a triangular shape.

6. The deformed folded dipole antenna according to claim 3, further comprising:

a plurality of inward protruding parts, wherein at least one set of the plurality of inward protruding parts are adjacent to each other and share an end point with each other.

7. The deformed folded dipole antenna according to claim 2, wherein the at least one inward protruding part has a stepped shape that includes:

a first long vertical portion that is vertical to a plane having the feed-side parallel part and is vertical to a plane having the non-feed side parallel part, and vertically extends from one end point of the at least one inward protruding part to the distal end toward an antenna widthwise center plane, which passes a widthwise center of the feed-side parallel part and a widthwise center of the non-feed side parallel part;

a distal end portion that has one end connected to a distal end of the first long vertical portion and is parallel to the antenna widthwise center plane;

a first short vertical portion that has one end connected to the distal end portion, and vertically extends from the distal end portion to the antenna widthwise center plane in a direction away from the antenna widthwise center plane;

a middle portion that has one end connected to the first short vertical portion, and extends from the first short vertical portion in a direction parallel to the antenna widthwise center plane and opposite from the first long vertical portion; and a second short vertical portion that is vertical to the antenna widthwise center plane, and has one end connected to the middle portion, and has another end forming an end point of the inward protruding part arranged at an opposite side from a side where the first long vertical portion is connected.

8. The deformed folded dipole antenna according to claim 1, wherein the inward protruding part includes:

a first vertical portion that is vertical to a plane having the feed-side parallel part and is vertical to a plane having the non-feed side parallel part, and vertically extends from one end point of the at least one inward protruding part to the distal end toward an antenna widthwise center plane, which passes a widthwise center of the feed-side parallel part and a widthwise center of the non-feed side parallel part;

a distal end portion that has one end connected to a distal end of the first vertical portion and is parallel to the antenna widthwise center plane; and a second vertical portion that is vertical to the antenna widthwise center plane, and has one end connected to the distal end portion and has another end forming an end point of the inward protruding part arranged at an opposite side from the first vertical portion.

9. The deformed folded dipole antenna according to claim 1, further comprising:

an end connector that electrically connects both end points of the at least one inward protruding part.

10. The deformed folded dipole antenna according to claim 9, wherein the end connector protrudes in a direction same as a protruding direction of the at least one inward protruding part.

11. The deformed folded dipole antenna according to claim 9, wherein the end connector protrudes in a direction opposite from a protruding direction of the at least one inward protruding part.

12. The deformed folded dipole antenna according to claim 1, wherein, in a plan view, the at least one inward protruding part is arranged between the pair of short circuit portions and at least one of the non-feed side parallel part and the feed-side parallel part.

13. A deformed folded dipole antenna, comprising:

a feed-side parallel part that has a feed point;

a non-feed side parallel part that has no feed point and is arranged to be parallel to the feed-side parallel part; and a pair of short circuit portions that have a length smaller than a length of the feed-side parallel part and a length of the non-feed side parallel part, and respectively connect to both ends of the feed-side parallel part and both ends of the non-feed side parallel part, wherein:

the non-feed side parallel part includes:

a pair of opposite sides that are arranged to be opposite from each other, and a connecting side that connects one end of one of the pair of opposite sides and one end of another one of the pair of opposite sides together;

the feed-side parallel part includes:

a first L-shaped portion that has a first side and a second side, which are respectively opposed to one portion of one of the pair of opposite sides of the non-feed side parallel part and one portion of the connecting side of the non-feed side parallel part, and a second L-shaped portion that has a first side and a second side, which are respectively opposed to one portion of another one of the pair of opposite sides of the non-feed side parallel part and the one portion of the connecting side of the non-feed side parallel part;

at least one of the feed-side parallel part and the non-feed side parallel part has one portion arranged with at least one inward protruding part, which protrudes inwardly into an area surrounded by the feed-side parallel part or the non-feed side parallel part; and in a plan view, the at least one inward protruding part is arranged between the pair of short circuit portions and at least one of the non-feed side parallel part and the feed-side parallel part, wherein the at least one inward protruding part has a width at a distal end of the at least one inward protruding part shorter than a width at a proximal end of the at least one inward protruding part.

14. The deformed folded dipole antenna according to claim 13, wherein the width of the at least one inward protruding part gets narrower continuously from the proximal end toward the distal end.

15. The deformed folded dipole antenna according to claim 14, wherein the at least one inward protruding part has a semi-elliptical shape.

16. The deformed folded dipole antenna according to claim 14, wherein the at least one inward protruding part has a triangular shape.

17. The deformed folded dipole antenna according to claim 14, further comprising:

a plurality of inward protruding parts, wherein at least one set of the plurality of inward protruding parts are adjacent to each other and share an end point with each other.

18. The deformed folded dipole antenna according to claim 13, further comprising:

an end connector that electrically connects both end points of the at least one inward protruding part.

19. A deformed folded dipole antenna, comprising:

a feed-side parallel part that has a feed point;

a non-feed side parallel part that has no feed point and is arranged to be parallel to the feed-side parallel part; and a pair of short circuit portions that have a length smaller than a length of the feed-side parallel part and a length of the non-feed side parallel part, and respectively connect to both ends of the feed-side parallel part and both ends of the non-feed side parallel part, wherein:

the non-feed side parallel part includes:

a pair of opposite sides that are arranged to be opposite from each other, and a connecting side that connects one end of one of the pair of opposite sides and one end of another one of the pair of opposite sides together;

the feed-side parallel part includes:

a first L-shaped portion that has a first side and a second side, which are respectively opposed to one portion of one of the pair of opposite sides of the non-feed side parallel part and one portion of the connecting side of the non-feed side parallel part, and a second L-shaped portion that has a first side and a second side, which are respectively opposed to one portion of another one of the pair of opposite sides of the non-feed side parallel part and the one portion of the connecting side of the non-feed side parallel part; and at least one of the feed-side parallel part and the non-feed side parallel part has one portion arranged with at least one inward protruding part, which protrudes inwardly into an area surrounded by the feed-side parallel part or the non-feed side parallel part, wherein the at least one inward protruding part has a width at a distal end of the at least one inward protruding part shorter than a width at a proximal end of the at least one inward protruding part, and wherein the at least one inward protruding part has a stepped shape that includes:

a first long vertical portion that is vertical to a plane having the feed-side parallel part and is vertical to a plane having the non-feed side parallel part, and vertically extends from one end point of the at least one inward protruding part to the distal end toward an antenna widthwise center plane, which passes a widthwise center of the feed-side parallel part and a widthwise center of the non-feed side parallel part;

a distal end portion that has one end connected to a distal end of the first long vertical portion and is parallel to the antenna widthwise center plane;

a first short vertical portion that has one end connected to the distal end portion, and vertically extends from the distal end portion to the antenna widthwise center plane in a direction away from the antenna widthwise center plane;

a middle portion that has one end connected to the first short vertical portion, and extends from the first short vertical portion in a direction parallel to the antenna widthwise center plane and opposite from the first long vertical portion; and a second short vertical portion that is vertical to the antenna widthwise center plane, and has one end connected to the middle portion, and has another end forming an end point of the inward protruding part arranged at an opposite side from a side where the first long vertical portion is connected.

* * * * *